US005253951A

United States Patent [19]

Peek

[11] Patent Number: 5,253,951

[45] Date of Patent: Oct. 19, 1993

[54] DRIVE SYSTEM AND METHOD FOR TRANSFERRING BARRIER SYSTEMS

[75] Inventor: Steven L. Peek, Walnut Grove, Calif.

[73] Assignee: Barrier Systems, Inc., Sausalito, Calif.

[21] Appl. No.: 790,364

[22] Filed: Nov. 12, 1991

[51] Int. Cl.[5] ..... E01F 13/00

[52] U.S. Cl. ..... 404/6; 404/72; 404/9

[58] Field of Search ..... 404/6, 9, 12, 72-73; 256/1, 13.1; 198/309, 816.2; 414/567; 16/361, 285

[56] References Cited

U.S. PATENT DOCUMENTS

| | | | |
|---|---|---|---|
| 4,167,826 | 9/1979 | Feliz | 404/84.05 X |
| 4,500,225 | 2/1985 | Quittner | 404/6 |
| 4,632,598 | 12/1986 | Richards | 404/6 |
| 4,653,954 | 3/1987 | Booth et al. | 404/6 |
| 4,666,332 | 5/1987 | Burgett | 404/72 X |
| 4,806,044 | 2/1989 | Duckett | 16/361 X |
| 4,828,425 | 5/1989 | Duckett | 16/361 X |
| 4,955,753 | 9/1990 | McKay | 256/13.1 X |

*Primary Examiner*—Kenneth J. Dorner
*Assistant Examiner*—Nancy P. Connolly
*Attorney, Agent, or Firm*—Phillips, Moore, Lempio & Finley

[57] ABSTRACT

A mobile transfer and transport vehicle is adapted to move a barrier system, having a plurality of pivotally interconnected and closely spaced modules, on a roadway or the like. The vehicle includes a conveyor having series of guide and support rollers for engaging, supporting, lifting and transferring the barrier system from a first side of the vehicle to a second side thereof. A drive system is mounted on the conveyor for frictionally engaging the modules to either pull or retard movement of the modules through the conveyor. The drive system aids in maintaining proper spacing between the modules, particularly when they are moved on a curved roadway.

16 Claims, 2 Drawing Sheets 11
15
16
19
20
21
22
23
24
25
26
27
28
29
30
31
32
33
H
S
P

DRIVE SYSTEM AND METHOD FOR TRANSFERRING BARRIER SYSTEMS

TECHNICAL FIELD

This invention relates generally to a mobile transfer and transport vehicle and more particularly to a drive system for the conveyor of a vehicle adapted to reposition a barrier system on a roadway or the like.

BACKGROUND OF THE INVENTION

The type of barrier system disclosed in U.S. Pat. No. 4,806,044 is adapted to be lifted by a mobile transfer and transport vehicle and moved to a selected position on a roadway or the like. Moveable barrier systems of this type find particular application at roadway construction sites and on roadways and bridges whereat the groupings of incoming and outgoing lanes of traffic must be varied, particularly during commute hours.

The barrier system comprises a series of interconnected concrete modules hinged together to form a continuous chain. The cross-section of each module is similar to that of a "Jersey-type" barrier, but has a T-shaped top section. A standard module has a height approximating thirty-two ins., a length approximating thirty-seven ins. and weighs approximately 1400 lbs. The modules are pivotally connected together by inserting a steel pin through hinge components attached to the ends of each adjacent pair of modules.

The self-propelled transfer and transport vehicle includes a conveyor system for shifting the barrier system laterally across the roadway from a first side to a second side of the vehicle. The shift or lateral displacement of the barrier system can be normally varied from four to eighteen feet. The conveyor system includes a plurality of guide and support wheels or rollers that function to engage beneath the T-shaped top section of the modules for lifting and transfer purposes.

The modules move through a serpentine-like transfer path (elongated "S" curve) for accurate positioning thereof to define a repositioned lane line. The modules are moved at a speed approximating five mph through the conveyor. Oftentimes, the vehicle must negotiate curved sections of roadways whereby the barrier system is likewise curved.

U.S. Pat. Nos. 4,806,044 and 4,828,425, both assigned to the assignee of this application, each address the long-standing problem of providing a barrier system that will elongate or contract to accommodate positioning of the system at varied radii on a curved roadway. The original barrier system, disclosed in U.S. Pat. No. 4,500,255, is particularly useful for straight-line roadway applications and utilizes a hinge connection between each adjacent pair of modules. The hinge connection includes aligned circular holes, formed in overlying hinge plates, adapted to receive a hinge pin therethrough. Even when the holes are lined with a thin (e.g., ⅛" wall thickness) elastomeric bushing, the modules may not elongate as a unit when the system is moved radially on a curved roadway.

For example, it has been determined that when the barrier system is moved from a 1,200 ft. radius to a 1,212 ft. radius, the composite length of the barrier system must increase by approximately 0.25 in. for each three feet in length of the barrier system to effectively accommodate this new position on the same, curved roadway. Conversely, repositioning of the barrier system radially inwardly to a new position on the curved roadway, having a radius of curvature of 1188 ft., will require a corresponding contraction of the composite length of the lane barrier system. In the above example, it should be understood that the ends of the barrier system are located at the same relative radial position on the curved roadway to thus require the aforementioned composite elongation or retraction of the system.

One solution to the latter problem of compensating for curvatures of varied radii on a curved roadway has been to substitute elongated slots for the pin-receiving circular holes, formed in the hinge plates. The slots allow the lane barrier system to assume various radii, as described in the above example. However, it has proven further desirable to return the spacing between each adjacent pair of modules to a nominal one when the barrier system is loaded onto a transfer vehicle and thereafter returned to its normal position on a roadway, e.g., the above-mentioned radius of 1200 ft.

Repeated transfer of the modules, having slotted hinge plates, will tend to "stack-up" the modules towards one of the ends of the lane barrier system which may interfere with effective transfer and placement of the modules in their correct positions. In particular, it is desirable to maintain the pivot pin between each adjacent pair of modules at a centered position therebetween (and reestablish the nominal spacing) when the barrier system is returned to its nominal position on a roadway. This feature, when achieved, facilitates the efficient transfer of the system by the type of transfer and transport vehicle described in the above-referenced patents.

The invention covered by above-referenced U.S. Pat. No. 4,806,044 solves this problem by providing elastomeric pads in the hinge connections, between each pair of adjacent modules of the barrier system, whereby the modules will: (1) elongate or contract to assume a composite varied length different from their nominal composite length in response to the imposition of a load on the system, and (2) return the modules to their nominal composite length when the load is removed. The invention covered by U.S. Pat. No. 4,828,425 solves the problem by preloading the hinges, connecting adjacent pairs of modules together, to facilitate a high degree of uniform spacing between the modules when they are moved through the conveyor of a self-propelled transfer and transport vehicle for subsequent replacement on a roadway.

SUMMARY OF THE INVENTION

An object of this invention is provide an improved drive system for the conveyor of a mobile transfer and transport vehicle and a unique method for pulling or retarding movement of a barrier system through a roadway or the like.

The barrier system comprises a plurality of interconnected modules and the vehicle includes a conveyor for engaging, supporting, lifting and transferring the barrier system from a first side of the vehicle to a second side thereof, along a generally serpentine-like transfer path. The conveyor includes series of spaced guides, such as guide and support wheels or rollers, disposed adjacent to the path. In one aspect of this invention, drive means are provided for engaging the modules for either pulling them through the conveyor or retarding movement thereof.

In another aspect, the invention is defined as a method, including the step of either pulling or retarding movement of the modules through the conveyor.

Thus, the modules can be uniformly spaced from each other when they are transferred on a roadway or the like. The drive system is adapted for use with the above-described slotted hinge connection and solves the above-discussed "stack-up" problem.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
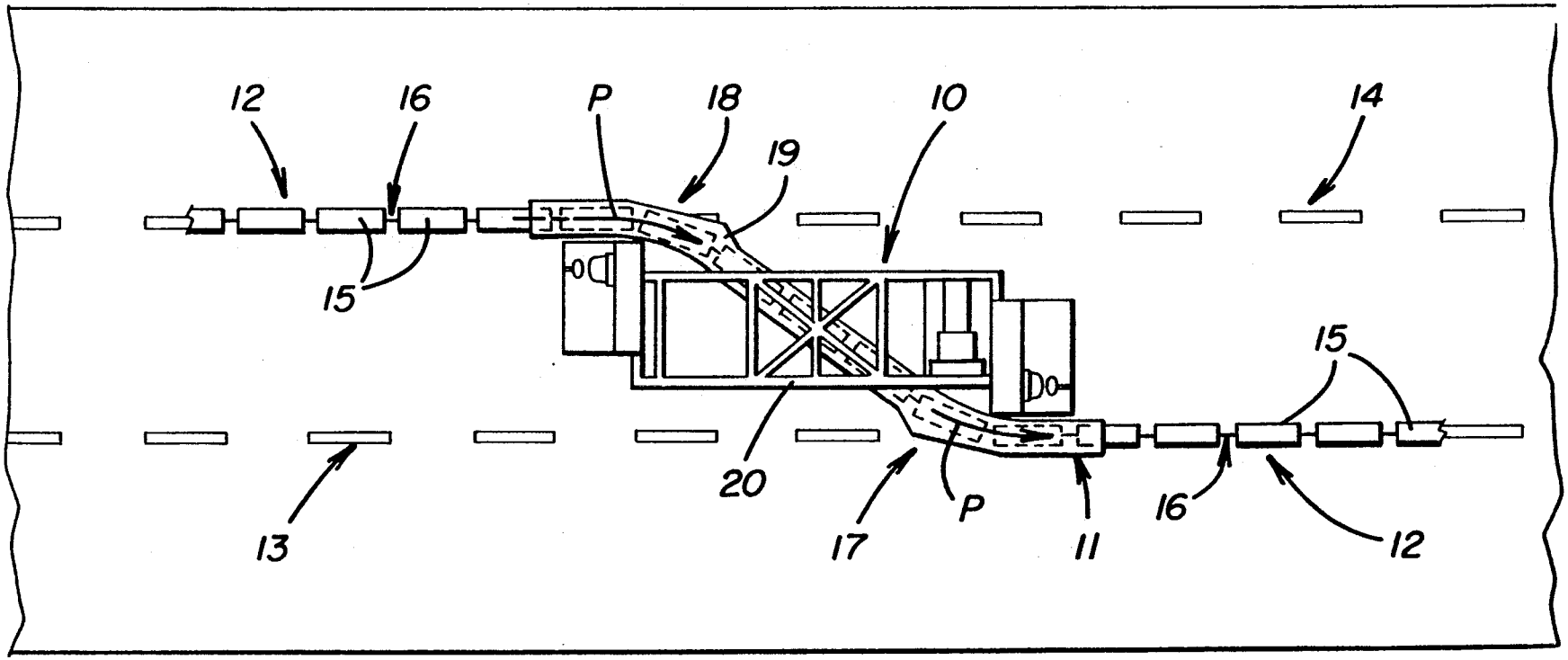
FIG. 1 is a top plan view schematically illustrating a mobile transfer and transport vehicle in the process of transferring a barrier system from a first position on a roadway to a laterally displaced second position thereon.

FIG. 1 schematically illustrates a transfer and transport vehicle 10 having a conveyor 11 adapted to engage, support, lift and transfer a barrier system 12 on a roadway. As described in U.S. Pat. Nos. 4,500,225 and 4,806,044, the barrier system is adapted to be transferred from a first position to a laterally displaced second position at a construction site or on a roadway for delineation and anti-crash barrier purposes. In the illustrated application, the vehicle can be moved rightwardly to transfer the barrier system from a standard first lane marker 13 to a parallel second lane marker 14 on the roadway.

Figures 2, 3, 4:
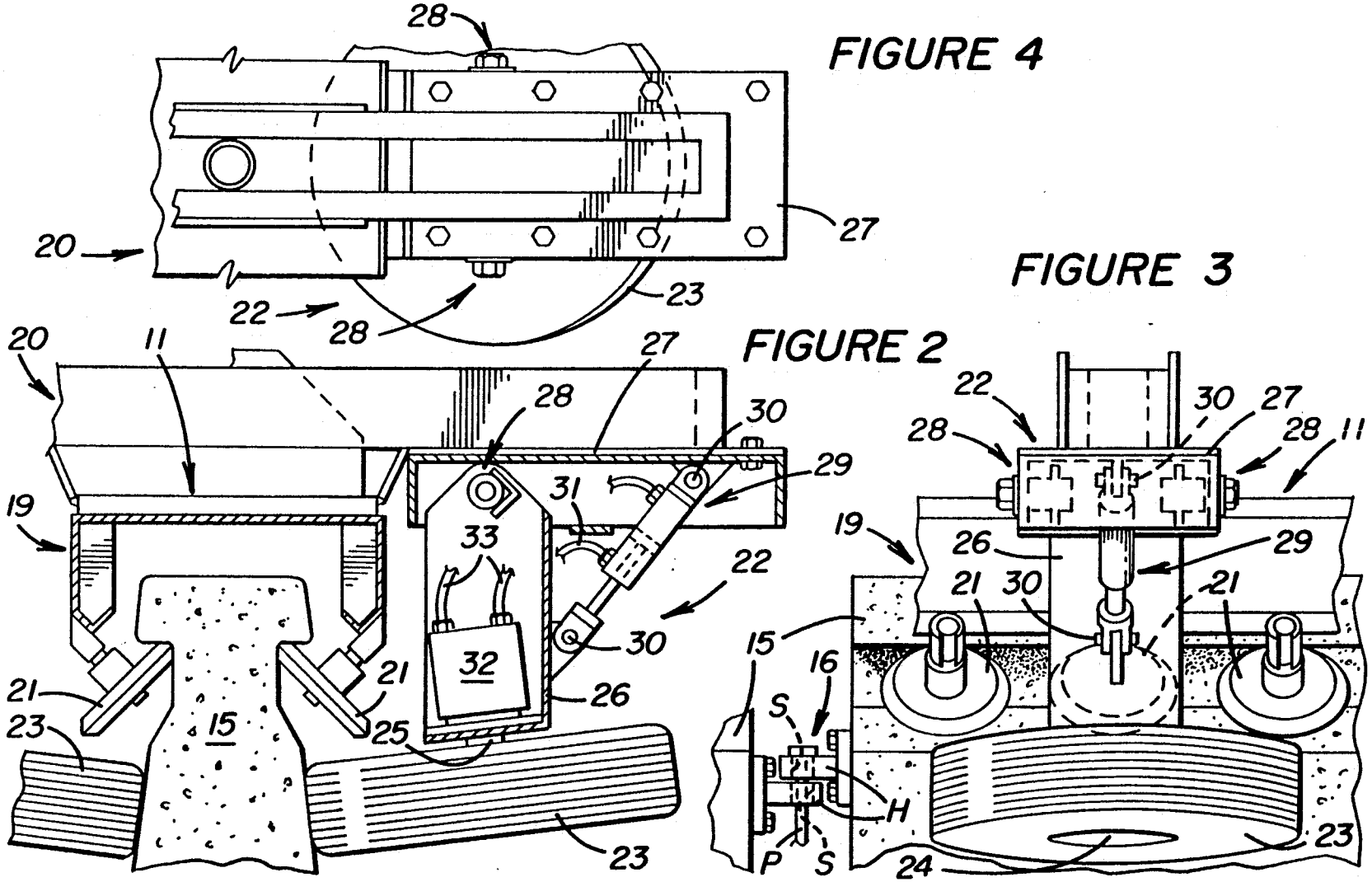
FIG. 2 is a partial cross-sectional view illustrating support of an individual module of the barrier system by a conveyor system and a pair of drive wheels of this invention frictionally engaged with either side of the module.
FIG. 3 is a partial side elevational view of one of the drive wheels and attendant components.
FIG. 4 is a top plan view thereof.

As further described in the above-referenced patents, barrier system 12 comprises a plurality of closely spaced and free-standing barrier modules 15 pivotally interconnected together at standard hinge connections 16 to form a chain-like system. As shown in FIG. 3, each hinge connection comprises a hinge plate H secured to each adjacent module 15 and a vertically disposed hinge pin P mounted in aligned and (longitudinally) elongated slots S in a conventional manner. The pin is further disposed in identical hinge plates (not shown) forming a second hinge connection disposed vertically below the illustrated ones, in a conventional manner.

As further shown in FIG. 1, transfer of the barrier system requires that they move through a serpentine-like path P (elongated "S" curve), including generally straight portions merged together at curved path portions defined at curved sections 17 and 18 of conveyor 11. It should be understood that mobile vehicle 10, suitably mounted on a plurality of roadwheels (not shown), can be moved in the opposite (leftward) direction in FIG. 1 to reverse the transfer of barrier system 12, i.e., from lane marker 14 to lane marker 13.

Referring to FIGS. 2–4, conveyor 11 includes a partially illustrated carrier frame 19 adapted to be suitably secured beneath a main frame 20 of vehicle 10 (FIGS. 1 and 2). As described in the above-referenced patents, opposed first and second series of fixed angled steel wheels or guide and support rollers 21 of conveyor 11 engage either side of the modules when they move along path P (FIG. 1). As shown in FIG. 2, when the modules move through the mid-portion of the conveyor (the approximate center of vehicle 10 in FIG. 1), a pair of drive means, preferably in the form of a pair of laterally opposed drive wheel assemblies 22 (one fully shown) function to simultaneously pull or retard the movement of the passing modules to overcome the above-discussed "stack-up" problem, i.e., to at least substantially maintain a uniform spacing between the modules.

In the illustrated embodiment shown in FIGS. 2–4, each drive wheel assembly 22 includes a drive wheel shown in the form of a solid elastomeric tire 23 that is clamped into frictional engagement with a respective side of module 15. The tire is composed of a suitable elastomeric material exhibiting sufficient flexibility, frictional qualities and related chemical and physical characteristics to provide the functional desiderata herein described. For example, the elastomeric material may comprise a non-degradable natural or synthetic rubber (e.g., urethane) having a durometer hardness approximating 50–80.

Tire 23 is suitably mounted on a hub 24 adapted to be rotated by a drive axle 25. The drive axle is rotatably mounted on a bracket 26, having its upper end pivotally mounted on a bracket 27 by a pair of laterally spaced pivots 28 (FIG. 3) Bracket 27 is suitably secured beneath main and carrier frames 18,19 and is adapted to be pivoted clockwise in FIG. 2 to selectively pivot tire 23 into frictional engagement with one side of module 15 under the influence of a double-acting clamping cylinder 29.

The rod and head ends of cylinder 29 are pivotally attached to brackets 26 and 27 by pins 30 whereby extension of the cylinder will function to pivot the bracket and tire in a clockwise direction in FIG. 2. Selective extension and retraction of the clamping cylinder can be effected by manipulation of standard controls (not shown) mounted in each of two cabs of vehicle 10, via line connections 31. Alternatively, the cylinder could be single-acting and normally spring-biased to its retracted position and selectively pressurized at its head end to its extended and operative position illustrated in FIG. 2.

A standard reversible drive motor 32 is suitably mounted on bracket 26, as shown in FIG. 2, and has its output shaft connected to drive axle 25 to selectively rotate tire 23 in either direction. For example, when a pulling force is applied to the modules tires 23 would be rotated in opposite directions at the same, appropriate speed. Line connections 33 ar adapted to connect the motor to a standard pump and control system, accessible to the vehicle's operator. Alternatively, motor 32 could constitute a reversible electric motor, well-known to those skilled in the art.

From the above description, it can be seen that when vehicle 10 moves down a roadway in FIG. 1 to transfer barrier system 12, that clamping cylinders (one shown in FIGS. 2 and 3) can be extended simultaneously to engage tires 23 on opposite sides of passing modules 15. Simultaneously therewith each motor 23 is actuated to rotate the tires in either direction or to "hold" each axle 25 to either apply pulling force to the modules in either direction or to apply a retarding force thereto, i.e., with motor 32 then functioning as a pump. As suggested above, the direction and speed of tire rotation will depend on the shape, radius and related factors pertaining to the pre-planned shape of the barrier system on a roadway to achieve the desired uniform spacing of the modules from each other when they move through conveyor 11.

The method for transferring barrier system 12 through serpentine-like path P by vehicle 10 will thus include the step of either pulling the modules through the conveyor or retarding movement of the modules through the conveyor. In the embodiment illustrated, the preferred method is one of engaging either side of the modules with an elastomeric tire in the manner described above.

Although one drive wheel assembly 22 could be used, two laterally apposed drive wheel assemblies are preferred to provide a "pinching" action or "back-up" for each other to continuously maintain intimate frictional contact of tires 23 with modules 15 and maintain their vertical dispositions. Further, the assemblies could be otherwise positioned on the vehicle and additional pairs of the assemblies could be utilized to increase the composite driving/retarding force applied to the modules.

I claim:

1. A mobile transfer and transport vehicle in combination with a barrier system having a plurality pivotally interconnected and closely spaced modules adapted to be positioned in free-standing relationship on a roadway or the like, said vehicle comprising a frame and conveyor means mounted on said frame for engaging, supporting, lifting and transferring said barrier system from a first side of said vehicle to a second side thereof, said conveyor means including a plurality of spaced guide means for engaging and supporting said modules and drive means for engaging said modules for either pulling said modules through said conveyor or retarding movement of said modules through said conveyor means, said drive means being movably mounted on the frame of said vehicle, independent of said guide means and disposed on at least one lateral side of said modules.

2. The combination of claim 1 wherein a said drive means is mounted on each lateral side of said modules.

3. The combination of claim 1 wherein said drive means is positioned at least approximately at the mid-portion of said vehicle.

4. The combination of claim 1 wherein said drive means comprises rotatable tire means for frictionally engaging said modules.

5. The combination of claim 4 wherein said drive means further comprises a bracket pivotally mounted on said frame and wherein said tire means comprises an elastomeric tire rotatably mounted on said bracket.

6. The combination of claim 5 wherein said drive means further comprises cylinder means for selectively pivoting said bracket on said frame and said tire into frictional engagement with said modules.

7. The combination of claim 6 wherein said drive means further comprises motor means for selectively rotating said tire.

8. The combination of claim 7 wherein said motor means is mounted on said bracket.

9. The combination of claim 8 wherein a said drive means is mounted on each lateral side of said modules.

10. A mobile transfer and transport vehicle comprising a frame, and conveyor means mounted on said frame for engaging, supporting, lifting and transferring a barrier system from a first side of said vehicle to a second side thereof, said conveyor means including a plurality of spaced guide means for engaging and supporting said modules, and drive means for engaging said modules for either pulling said modules through said conveyor means or retarding movement of said modules through said conveyor means, said drive means being movably mounted on the frame of said vehicle, independent of said guide means and disposed on at least one lateral side of said modules.

11. The vehicle of claim 10 wherein said drive means is positioned at least approximately at the mid-portion of said vehicle.

12. The vehicle of claim 10 wherein said drive means comprises rotatable elastomeric tire means for frictionally engaging said modules and a bracket pivotally mounted on said frame, said tire means being rotatably mounted on said bracket.

13. The vehicle of claim 12 wherein said drive means further comprises cylinder means for selectively pivoting said bracket on said frame and said tire means into frictional engagement with said modules.

14. The vehicle of claim 13 wherein said drive means further comprises motor means for selectively rotating said tire means.

15. The vehicle of claim 14 wherein said motor means is mounted on said bracket.

16. The vehicle of claim 15 wherein a said drive means is mounted on each lateral side of said conveyor means.

* * * * *